US005118107A

United States Patent [19]

Bucher

[11] Patent Number: 5,118,107

[45] Date of Patent: Jun. 2, 1992

[54] RAIN COVER FOR GOLF CLUB HANDLE

[75] Inventor: Jeffrey M. Bucher, Livonia, Mich.

[73] Assignee: Bucher Inc., Livonia, Mich.

[21] Appl. No.: 606,502

[22] Filed: Oct. 31, 1990

[51] Int. Cl.[5] ..... A63B 49/08

[52] U.S. Cl. ..... 273/81 R; 273/75; 273/81.2

[58] Field of Search ..... 273/81 R–81 D, 273/165, 166, 81.2–81.6, 67 C, 67 D, 67 DA, 67 DB, 73 J, 75, 72 R; 24/419, 381, 429, 420; 43/23

[56] References Cited

U.S. PATENT DOCUMENTS

| | | | |
|---|---|---|---|
| 896,689 | 8/1908 | Canfield | 24/429 |
| 1,617,972 | 2/1927 | Wallance | 273/81 R |
| 1,860,561 | 5/1932 | Warner | 273/72 R |
| 2,002,535 | 5/1935 | Gagnier | 273/81 |
| 2,309,933 | 2/1943 | Churchill | 273/75 |
| 2,793,136 | 5/1957 | Root | 273/81 R |
| 2,984,486 | 5/1961 | Jones | 273/75 |
| 4,012,039 | 3/1977 | Yerke | 273/81 R |
| 4,098,506 | 7/1978 | Gaiser | 273/81 R |
| 4,133,529 | 1/1979 | Gambino | 273/81 R |
| 4,159,115 | 6/1979 | Ticktin et al. | 273/75 |
| 4,160,306 | 7/1979 | Pizzoccaro | 24/381 |
| 4,476,742 | 10/1984 | Midgley | 273/81 D |
| 4,567,091 | 1/1986 | Spector | 273/81 D |
| 4,651,991 | 3/1987 | McDuff | 273/75 |
| 4,662,415 | 5/1987 | Proutt | 273/81 R |

FOREIGN PATENT DOCUMENTS

| | | | |
|---|---|---|---|
| 27613 | 11/1910 | United Kingdom | 273/81 R |
| 360097 | 11/1931 | United Kingdom | 273/81 R |

OTHER PUBLICATIONS

Photocopy of packaging and mesh product known as "Golfer's Rain Grip".

*Primary Examiner*—Theatrice Brown
*Assistant Examiner*—Steven B. Wong
*Attorney, Agent, or Firm*—Charles W. Chandler

[57] ABSTRACT

A rain cover for a golf club formed of a porous, non-woven, non-absorbent fibrous material having either a silicon carbide or aluminum oxide abrasive material.

11 Claims, 1 Drawing Sheet

RAIN COVER FOR GOLF CLUB HANDLE

BACKGROUND AND SUMMARY OF THE INVENTION

This invention relates to golf clubs, and particularly to a detachable rain cover for the handle of a golf club.

The handle portions of many golf clubs are covered with a rubber-like material. A relatively thin cover or sleeve is slipped over and around a steel shaft portion of the club. The length of the rubber sleeve is on the order of twelve inches. The steel shaft gives the handle a desired rigidity, whereas the thin rubber sleeve has a slight compressibility and friction fit in the golfer's hands, whereby the golfer can maintain a firm grip on the handle while swinging the club.

When the club is used in the rain, the surface of the handle can become wet and somewhat slippery, to the extent that the golfer may not be able to maintain a firm slip-free grip on the handle while swinging the club. The present invention is directed to a removable cover that can be slipped over the conventional rubber handle of a golf club when the club is to be used in the rain. The rain cover is formed of a porous sheet of matted fibers intertwined together in random crossing patterns so that a multiplicity of pores extend within and through the sheet. The fibers are formed of a non-absorbent material with either a silicon carbide or aluminum oxide abrasive material. Each fiber has a relatively small diameter of approximately 0.001 inch (on the order of thickness of a human hair). The wall thickness of the porous sheet is about one eighth inch (in the uncompressed state). When the golfer's hands grip the cover surface, the intertwined fibrous material in contact with the golfer's fingers is compressed toward the rubber handle surface. The ready compressibility of the porous fiber sheet enables the golfer to have essentially the same feel (or grip) on the club as he/she would normally have when the cover is not used. Thus, the effective handle diameter is approximately the same so that the golfer can use the same gripping action, stance, and arm motion as used under normal dry conditions.

Rain accumulating on the porous sheet can migrate into the pores of the fibrous material. The fiber surfaces can be wet, but due to the extremely small diameter of each fiber and the spacing between fibers, the overall surface of the rain cover is relatively rough (somewhat like sandpaper, although much more compressible and deformable). The grip of the person's hands on the roughened, compressible cover surface will cause any water within the compressed portion of the cover to be squeezed into other portions of the cover so that the presence of water on (or in) the rain cover does not interfere with a good hand grip on the cover.

I am aware of some patents disclosing golf club handles or handle covers formed of fibrous materials. U.S. Pat. No. 1,617,972, issued to R. Wallace, shows a handle formed out of woven cotton fabric. Such a fabric would readily absorb rain water, giving it a relatively slippery overall surface. U.S. Pat. No. 4,159,115 issued to Ticktin et al and U.S. Pat. No. 4,651,991 issued to M. McDuff each disclose handles formed of terry cloth, which is water-absorbent. The effect of rain water on the terry cloth would be a water-soaked surface wherein a slippery water film could readily form along the interface between the person's skin and the water-soaked fibers of the terry cloth.

U.S. Pat. No. 2,002,535 issued to G. Gagnier discloses a golf club gripping surface formed by a pile fabric that is defined by a woven backing sheet and pile yarns extending outward from the backing sheet radially away from the club handle surface. The patentee indicates that the pile material is resilient. Presumably the pile material would be a synthetic organic material, such as nylon. Such materials become relatively slippery when wet.

The rain cover of the present invention is believed to have practical advantages over the handle coverings shown in the above-noted patents.

THE DRAWINGS

DESCRIPTION OF A PREFERRED EMBODIMENT OF THE INVENTION

The drawings show a conventional golf club that includes a rigid tubular shaft 10 and a rubber sleeve 12 tightly encircling the shaft. The sleeve has an upper butt end 14 and a lower end 16 located at an intermediate point along the club shaft. In the use of the golf club under normal (dry) conditions, the golfer grips the outer surface of sleeve 12 when swinging the club.

Figure 2:
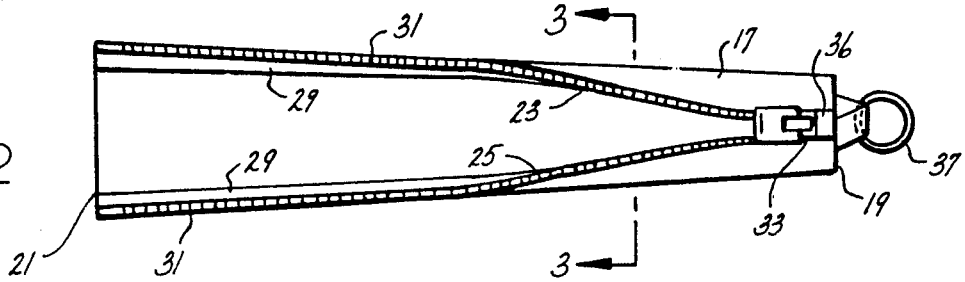
FIG. 2 is a side elevational view of a golf club cover embodying my invention.
Figure 3:
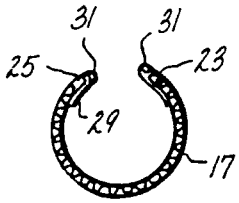
FIG. 3 is a sectional view taken on line 3—3 in FIG. 2.

The present invention is directed to a removable sleeve or rain cover installable on sleeve 12 of the golf club when it is desired to play in the rain. As shown in FIG. 2, the rain cover comprises a porous, flexible sheet 17 having a first end edge 19 adapted to extend around sleeve 12 near its butt end, and a second end edge 21 adapted to encircle sleeve 12 near its lower end 16. Sheet 17 further includes two elongated side edges 23 and 25 adapted to extend longitudinally along the side surface of sleeve 12.

Figure 4:
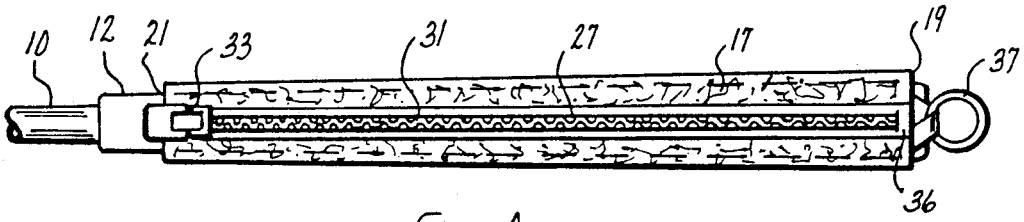
FIG. 4 is a view taken in the same direction as FIG. 2, but showing the cover installed on the FIG. 1 golf club.
Figure 6:
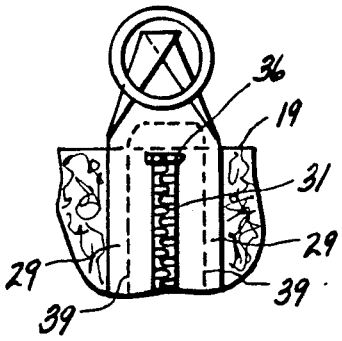
FIG. 6 is a fragmentary view of the inside surface of the FIG. 2 cover, showing a strip extension mechanism for attaching a pull ring to the cover.

A conventional zipper structure 27 is stitched (sewn) or otherwise attached to edge areas 23 and 25 of the porous sheet, to maintain the rain cover in an operative, encircling position on sleeve 12. The illustrated zipper structure comprises two zipper attachment strips 29 stitched to side edges 23 and 25 of sheet 17. Rows of interengagable teeth 31 project from strips 29 at evenly spaced points therealong. The teeth are interengaged by a manually-actuable slidable operator 33 that has channel-shaped side edges forming guidance surfaces for separating or merging the registering teeth, depending on the direction of movement of the operator. FIG. 2 shows the zipper structure in an open unlocked condition. FIG. 4 shows the zipper structure in a fully locked condition.

At its right end, the zipper structure includes a tooth-encircling brad element 36 that extends through strips 29 so that the first three or four sets of teeth 31 are permanently interlocked. The right end portion of the rain cover is thus permanently formed into a circular configuration for convenient slip-on engagement over the butt end 14 of golf club sleeve 12. After the rain cover is thus partially installed on sleeve 12, the zipper operator 33 is pulled leftwardly to the FIG. 4 condition, wherein the cover tightly encircles handle 12 along the entire length of the cover. Removal of the rain cover is accomplished by sliding operator 33 to the right, and pulling the cover off the butt end of sleeve 12.

Figure 1:
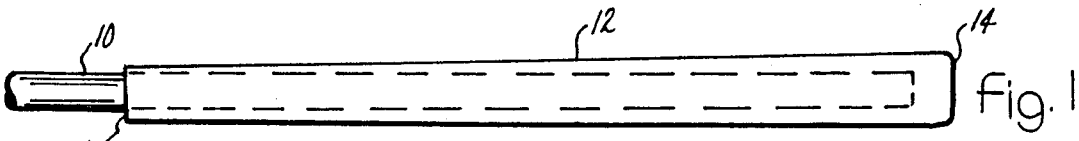
FIG. 1 is a fragmentary side elevational view of a conventional golf club handle.

As shown in FIG. 1, the conventional golf club handle is slightly tapered from its upper butt end to its lower end 16. The rain cover is correspondingly tapered so that the cover will fit tightly on the handle surface at all points therealong. Typically, end edge 21 of the cover has a circumferential length of about two and one-half inches, whereas the other end edge 19 of the cover has a length of about four inches (in the compressed state).

Figure 5:
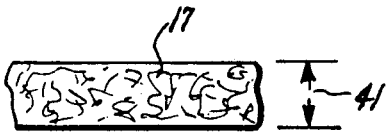
FIG. 5 is a fragmentary enlarged sectional view through the wall cross section of a porous sheet used in the FIG. 2 cover.

In order to facilitate leftward motion of the zipper operator 33 in the teeth-locking direction, the rain cover has a puller element 37. Element 37 is shown as a circular metal ring, although it could have different configurations. Element 37 is attached to sheet 17 by extending end portions of strips 2 beyond the end edge of sheet 17 through the ring, and then continuing the strip 29 material back onto itself into the space circumscribed by the cylindrical portion of sheet 17. The doubled-back portions of strips 29 are stitched to the strip material into a loop configuration suitable for retaining the ring 37 in axial alignment with the zipper structure. FIG. 5 shows the ring-attachment mechanism in a position wherein strips 29 are edge-folded and extended through ring element 37 (but prior to the strips being doubled back onto the zipper structure). Stitching for strips 29 is indicated by numeral 39.

In use of puller element 37, the golfer will position the circular end portion of the cover around the butt end of sleeve 12. The golfer then grips element 37 between the thumb and first finger of one hand, while using the other hand to exert a downward (leftward) pulling motion on operator 33. Since puller element 37 is in axial alignment with the zipper structure, it provides a good anchorage point for keeping the cover in place on handle 12 while operator 33 is being pulled leftwardly along the zipper structure.

A major feature of this invention is the construction of porous cover sheet 17. The sheet, in preferred form, is a commercially available product produced by Norton Company at 1 Bond Street, Worcester, Mass., under the tradename "Bear Tex". The sheet is available in the form of flat cloth-like sheets.

The fibrous sheet, as supplied by the Norton Co. under the tradename "Bear Tex", contains abrasive particles having silicon carbide or aluminum oxide abrasive material. The material in its conventional usage is supplied as a polishing or fine grinding cloth for use in smoothing or polishing wood or metal surfaces, either by hand or by machine (sander).

I have found the abrasive fibers to be advantageous for my purposes in that they tend to minimize any slippage between the user's hand and club handle, even in the presence of considerable moisture approaching saturation level.

The individual fibers in sheet 17 have extremely small diameters, on the order of 0.001 inch (about the size of a human hair). In the normal condition of the porous sheet, the sheet has a high void content (porosity) somewhat akin to that of a spun fiberglass air filter element. The sheet is transparent to light rays, such that a person could readily see through the sheet material, given the right lighting conditions.

The fibrous material will not absorb water. However, rain water can accumulate within the pores formed between the fibers. When the golfer exerts a gripping force on the porous cover sheet the fibers readily contract toward and against the surface of sleeve 12 so that the effective diameter of the handle is not appreciably increased. The cover sheet can easily be compressed from a wall thickness of about one-eighth inch to a thickness on the order of one-fiftieth inch (0.02 inch). The porous sheet has a wall thickness dimension 41 (FIG. 5) of about one-eighth inch, in the normal (uncompressed) condition of the sheet. The golfer thus has essentially the same grasp diameter on the club under both rainy and dry conditions. Water in the pores of the compressed portion of the rain cover is squeezed laterally into non-compressed portions of the sheet.

Because of the very small fiber diameter, the rain cover has a very large number of fiber edges presented to the golfer's hands. The cover surface has a rough texture somewhat similar to sandpaper, except that the surface is easily compressed so as to readily deform to the shape of the person's hand. Under wet conditions, the golfer can maintain a firm non-slip grip on the roughened cover surface.

I claim:

1. A rain cover for the handle of a golf club, comprising:

a tapered sleeve suited for removably mounting on the handle of a golf club, said sleeve being formed of an unbacked, nonwoven, porous, non-water absorbent, fibrous material containing abrasive particles.

2. A rain cover as defined in claim 1, in which the fibrous material includes a silicon carbide abrasive material.

3. A rain cover as defined in claim 1, in which the fibrous material has an aluminum oxide abrasive material.

4. A removable rain cover for a golf club handle having an upper butt end and a lower end located at an intermediate point along the club shaft, said rain cover comprising:

a porous sheet of matted, non-water absorbent fibers containing abrasive particles, with first and second end edges adapted to extend, respectively, around the handle near its butt end, and near its lower end;

said sheet further having first and second elongated side edges adapted to extend along the side surface of the handle between its end edges;

zipper means for joining the side edges of said sheet together, whereby the sheet can extend along and around a tapered golf club handle; said zipper means comprising first and second elongated zipper attachment strips affixed to respective ones of the sheet side edges, rows of interlockable teeth projecting from said strips at evenly spaced points therealong, and a slidable operator movable along the rows of teeth to lock or unlock the registering teeth;

means at said first end of the sheet for permanently connecting the two zipper attachment strips together whereby the zipper teeth adjacent said first end of the sheet are permanently interlocked; and said porous sheet being comprised of flexible, non-absorbent, hair-size fibers intertwined together in random crossing patterns, whereby pores are formed between the fibers; said fibers containing abrasive particles; said sheet having an appreciable wall thickness so that when the cover surface is gripped, the matted fibers are compressed toward the club handle surface.

5. A rain cover as defined in claim 4, in which the fibrous material includes a silicon carbide abrasive material.

6. A rain cover as defined in claim 4, in which the fibrous material contains aluminum oxide abrasive particles.

7. The rain cover of claim 4, wherein said porous sheet has a wall thickness of about one-eighth inch in its uncompressed state.

8. The rain cover of claim 4, wherein said fibers have diameters on the order of 0.001 inch.

9. The rain cover of claim 4, and further comprising a puller element extending from said first end of the porous sheet in alignment with said zipper means, whereby the golfer can grasp the puller element with one hand and the zipper operator with the other hand to facilitate slidable motion of the operator in the teeth-locking direction.

10. The rain cover of claim 4, wherein said puller element is a ring; at least one of said zipper attachment strips extending beyond said first end of the sheet through the ring and back onto the strips to secure the ring to the sheet.

11. The rain cover of claim 4, wherein said porous sheet constitutes the entire wall cross-sectional thickness of the rain cover; said porous sheet being readily compressible to a thickness that is only a minor fraction of its thickness in the normal uncompressed state, whereby the effective diameter of the golf club handle is not significantly increased due to the presence of the rain cover.

* * * * *